United States Patent [19]

Yakiwchuk

[11] 4,070,771

[45] Jan. 31, 1978

[54] PORTABLE SNOW BLOWER

[75] Inventor: John Yakiwchuk, Edmonton, Canada

[73] Assignee: The Raymond Lee Organization, Inc., New York, N.Y. ; a part interest

[21] Appl. No.: 740,189

[22] Filed: Nov. 9, 1976

[51] Int. Cl.[2] ..... E01H 5/02

[52] U.S. Cl. ..... 37/53; 15/344; 15/405

[58] Field of Search ..... 37/53, 16, 43 R, 12, 37/18; 15/300 R, 340, 344, 405, 415 A

[56] References Cited

U.S. PATENT DOCUMENTS

| | | | |
|---|---|---|---|
| 266,121 | 10/1882 | Etzler | 37/18 X |
| 3,053,460 | 9/1962 | Rudy | 37/53 |
| 3,174,477 | 3/1965 | Wilson | 37/16 X |
| 3,189,021 | 6/1965 | Giguere | 37/12 X |
| 3,619,917 | 11/1971 | Fischer | 37/18 X |
| 3,735,510 | 5/1973 | Godfrey | 37/43 R |

FOREIGN PATENT DOCUMENTS

| | | | |
|---|---|---|---|
| 363,779 | 12/1972 | U.S.S.R. | 37/12 |

*Primary Examiner*—E. H. Eickholt
*Attorney, Agent, or Firm*—Howard I. Podell

[57] ABSTRACT

A portable snow blower which may be employed on the roof of a building or vehicle to remove snow without damage to the roof on which the snow lies. The unit is formed of a shaped housing fitted at its rear with an external handle and enclosing a powered air blower. The discharge opening of the blower is located at a forward tapered end section of the housing, with the opening extending across the top of the end section, and with the bottom portion of the end section of the housing being enclosed.

1 Claim, 4 Drawing Figures

PORTABLE SNOW BLOWER

SUMMARY OF THE INVENTION

My invention is a portable snow blower which may be employed on the roof of a building or vehicle to remove snow without damage to the roof on which the snow lies. The unit is formed of a shaped housing fitted at its rear with an external handle and enclosing a powered air blower. The discharge opening of the blower is located at a forward tapered end section of the housing, with the opening extending across the top of the end section, and with the bottom portion of the end section of the housing being enclosed.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
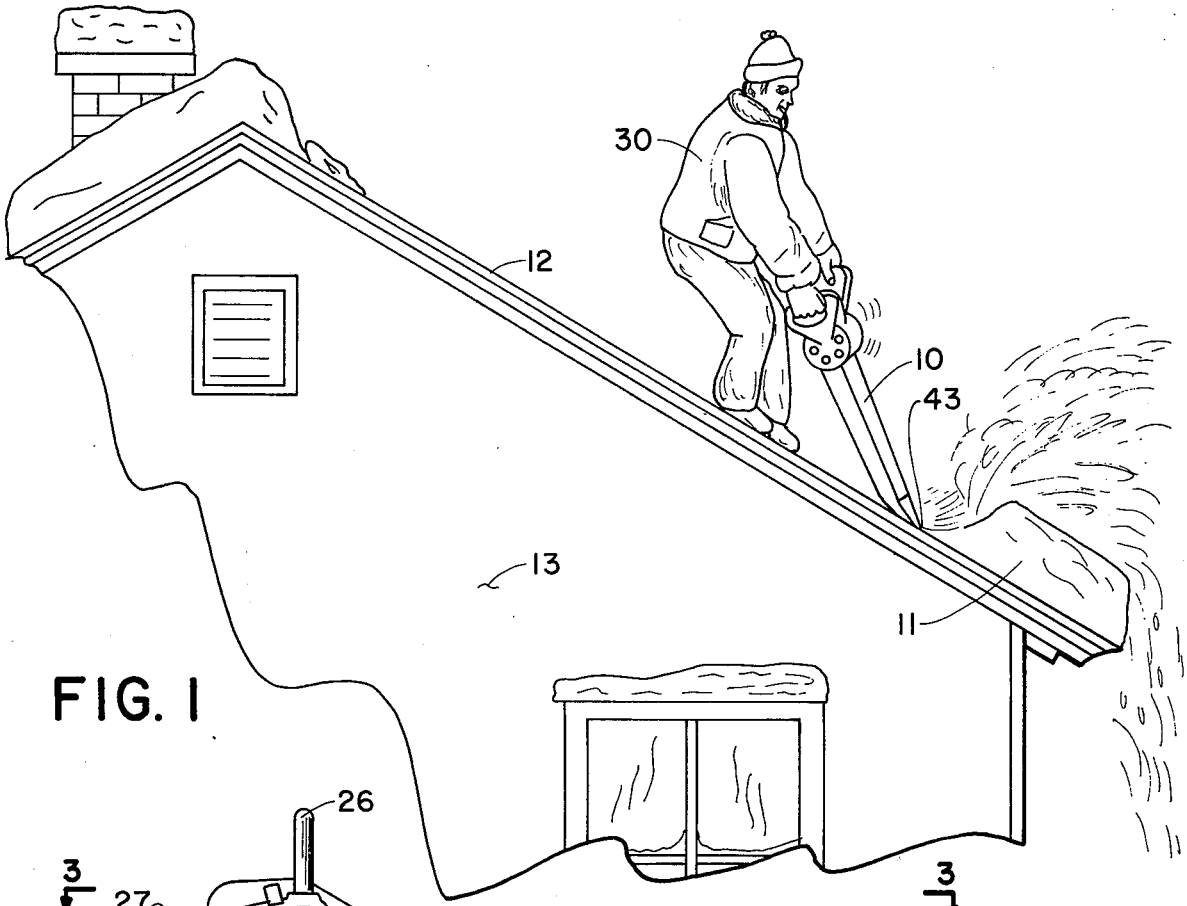
FIG. 1 is a side view of the invention in use.
Figure 2:
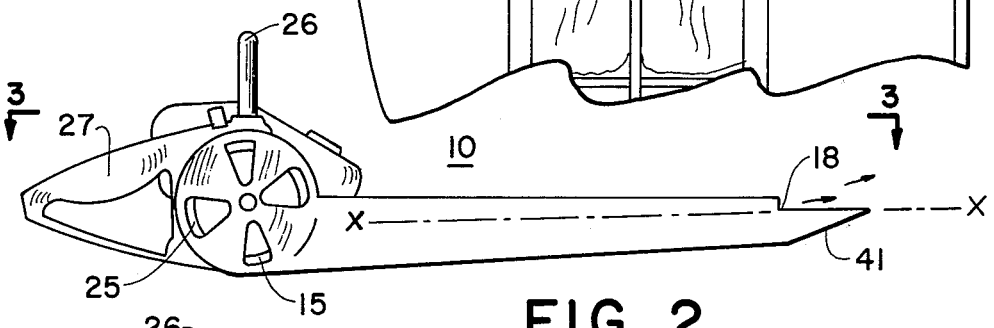
FIG. 2 is a side view of the invention.
Figure 3:
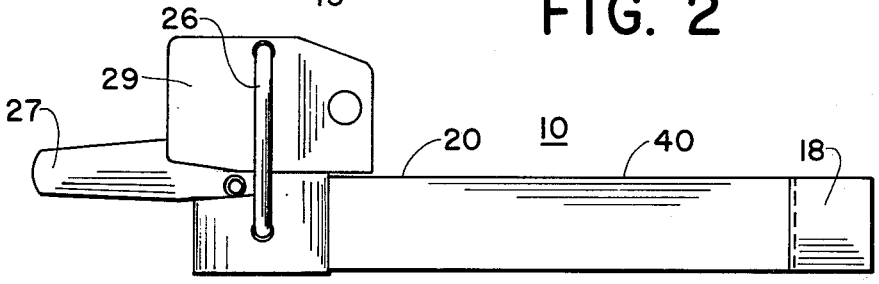
FIG. 3 is a plan view of the invention.
Figure 4:
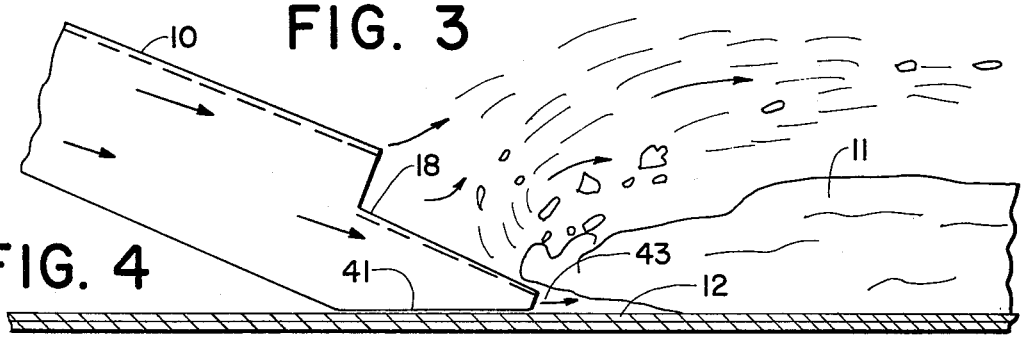
FIG. 4 is a fragmentary side view of the invention in use.

Turning now descriptively to the drawings in which similar reference characters denote similar elements throughout the several views, FIGS. 1–4 illustrate the portable snow blower unit 10 which may be readily employed to remove snow 11 lying on the roof 12 of a house 13 or from the roof of a vehicle without damage to the roof.

The blower unit 10 is formed of a housing 20 in which a blower 28, powered by a gasoline or electric motor (not shown) is mounted to draw air in through rear side openings 15 and exhaust the air through a front discharge port 18 of a chute section 40.

Housing 20 is formed with a pair of attached handles 26 and 27, with handle 26 extending over the top rear section 29 of the housing enclosing the motor and blower 25 and handle 27 extending rearwards from the housing to enable a user 30 to grasp the unit 10 with both hands, with one handle mounted approximately over the center of gravity of the unit 10 for furnishing lift and the other handle 27 mounted further to the rear for manually applying a pushing vector force and a rotational torque to the housing 20.

A chute section 40 of the housing extends forward of the rear section 29, which encloses the blower 25, to enclose the exhaust air and lead it out of exhaust port 18. Exhaust port 18 is located in the forward most upper section of chute section 40 open to the top and forward end of chute section 40, with the lower forward section of chute section 40 formed of panel section 41 oriented at an acute angle to the axis X—X of the chute section so that exhaust air 43 directed in a forward direction out of the open top section and open end section of chute section 40 will emerge at a generally acute angle to the plane of panel section 41 and to a roof 12.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A portable snow blower unit fitted with a housing enclosing a powered blower, said housing formed as a chute for enclosing exhaust air from the blower to a port at the forward end of the housing, in which the forward end of the housing is formed with an open port section extending across the forward end and forward upper end of the housing, with the bottom forward end section of the housing, below said port section, externally extending as a flat surface towards the forward end of the housing, said flat surface oriented at an acute angle taken from the port opening, to the axis of the chute of the housing, and at an obtuse angle to the remainder of the undersurface of the housing to the rear of said flat surface, together with a handle externally mounted on an upper section of the housing, so that with the unit manually gripped by the said handle, the unit may be slid with said flat surface resting on a base surface in the direction of the forward end of the housing with air flowing from the chute at an obtuse angle to the said base surface forward of the chute port section so as to blow snow on said base surface away from said port.

* * * * *